United States Patent [19]

Nicolaides et al.

[11] 4,205,608

[45] Jun. 3, 1980

[54] FUZE WELL STRESS ATTENUATOR FOR PROJECTILES

[75] Inventors: Spero Nicolaides, Andover; Sylvestro J. Ruffini, Budd Lake, both of N.J.

[73] Assignee: The United States of America as represented by the Secretary of the Army, Washington, D.C.

[21] Appl. No.: 927,446

[22] Filed: Jul. 24, 1978

[51] Int. Cl.[2] ..... F42C 19/04

[52] U.S. Cl. ..... 102/1 R

[58] Field of Search ..... 102/200, 1 R

[56] References Cited

U.S. PATENT DOCUMENTS

| | | | |
|---|---|---|---|
| 620,387 | 2/1899 | Wang | 102/200 |
| 918,560 | 4/1909 | De Lanneau | 102/200 |
| 1,313,088 | 8/1919 | Hathaway | 102/200 |
| 1,416,856 | 5/1922 | Mitzel | 102/200 |
| 3,173,364 | 3/1965 | Nordzell | 102/1 R |

FOREIGN PATENT DOCUMENTS

| | | | |
|---|---|---|---|
| 625936 | 8/1927 | France | 102/200 |
| 864202 | 4/1941 | France | 102/200 |
| 275230 | 6/1930 | Italy | 102/200 |

*Primary Examiner*—Charles T. Jordan

*Attorney, Agent, or Firm*—Nathan Edelberg; Robert P. Gibson; Harold H. Card, Jr.

[57] ABSTRACT

To avoid impact damage to the fuze well of an artillery projectile when it is accidentally dropped during handling, a plastically deformable safety collar is affixed around the fuze well, and a threaded lift plug is secured within the fuze well to clamp the collar around the fuze well.

9 Claims, 4 Drawing Figures

FUZE WELL STRESS ATTENUATOR FOR PROJECTILES

GOVERNMENTAL INTEREST

The invention described herein may be manufactured, used and licensed by or for the U.S. Government for governmental purposes without payment to me of any royalty thereon.

BACKGROUND OF THE INVENTION

This invention relates to projectiles and to a protective nose cap structure for projectiles which are handled under conditions involving a risk of being accidentally dropped or otherwise impacted.

Rough handling of artillery projectiles is commonplace due to their high weight and bulk, plus the fact that orderly and deliberate handling procedures are not characteristics of battlefield conditions. When projectiles are dropped on a hard surface such as concrete, concentrated local stress reaching a high level is produced at the point of impact. While the projectile walls are necessarily strong and may be expected to resist deformation, actual or incipient cracking of the wall is occasionally experienced.

Discontinuities, cracks or crack-like defects, regarded as possible failure initiation sites inherent in the projectile material, may or may not be detectable upon inspection. Limits for acceptable flaw sizes in projectiles are defined and accordingly projectiles are screened for field use. The problem exists however, that after a projectile passes inspection and in the course of routine handling prior to firing an innocuous flaw size can become a critical flaw size, and thus become a "primed" failure initiation site capable of producing premature projectile failure under the normal load conditions of firing. Such growth, or enlargement of flaws can occur under conditions where a high, localized and crack-opening stress is encountered, as in the case of impact. As materials, generally, possess a crack size tolerance, or "fracture toughness", for a given load or stress level, the projectile material has a tolerable crack size than can safely survive the launch stresses. The more brittle, or the more of a fragmentation quality, a projectile is, the smaller is the crack size that it can tolerate at a given stress—the "primed", or critically-sized flaw may be such, that not only will it readily escape visual detection, but also, that it can escape detection by more precise inspection techniques. In any event, the firing of a projectile with a "primed" or critically-sized flaw will result in a mechanically-unstable projectile incapable of withstanding the stresses encountered in firing; this could result in a premature, or an in-bore failure of grave consequence.

Experimental stress analysis of projectiles, having a lift plug screwed into the fuze well, subjected to simulated rough handling in accordance with the U.S. Army Test and Evaluation Command Material Test Procedure-MTP 4-2-602, "Rough Handling Tests", quantitatively showed the fuze well of the projectile to be especially vulnerable to this sort of structural instability. The invention described herein, presents a solution to this problem.

SUMMARY OF THE INVENTION

The invention consists of two parts; a collar which fits around the fuze well region of the projectile (see FIG. 1) and a modified lift plug (see FIG. 2). The collar is designed to absorb impact energy by plastic deformation when the projectile is dropped. Deformation of the collar results in wider distribution of the impact force, thus avoiding localized stress at the fuze well of the projectile.

The lift plug is less rigid than the projectile walls so as to promote deformation of the plug rather than transferring impact energy to the projectile if it is accidentally dropped.

DETAILED DESCRIPTION OF THE INVENTION

Figure 1:
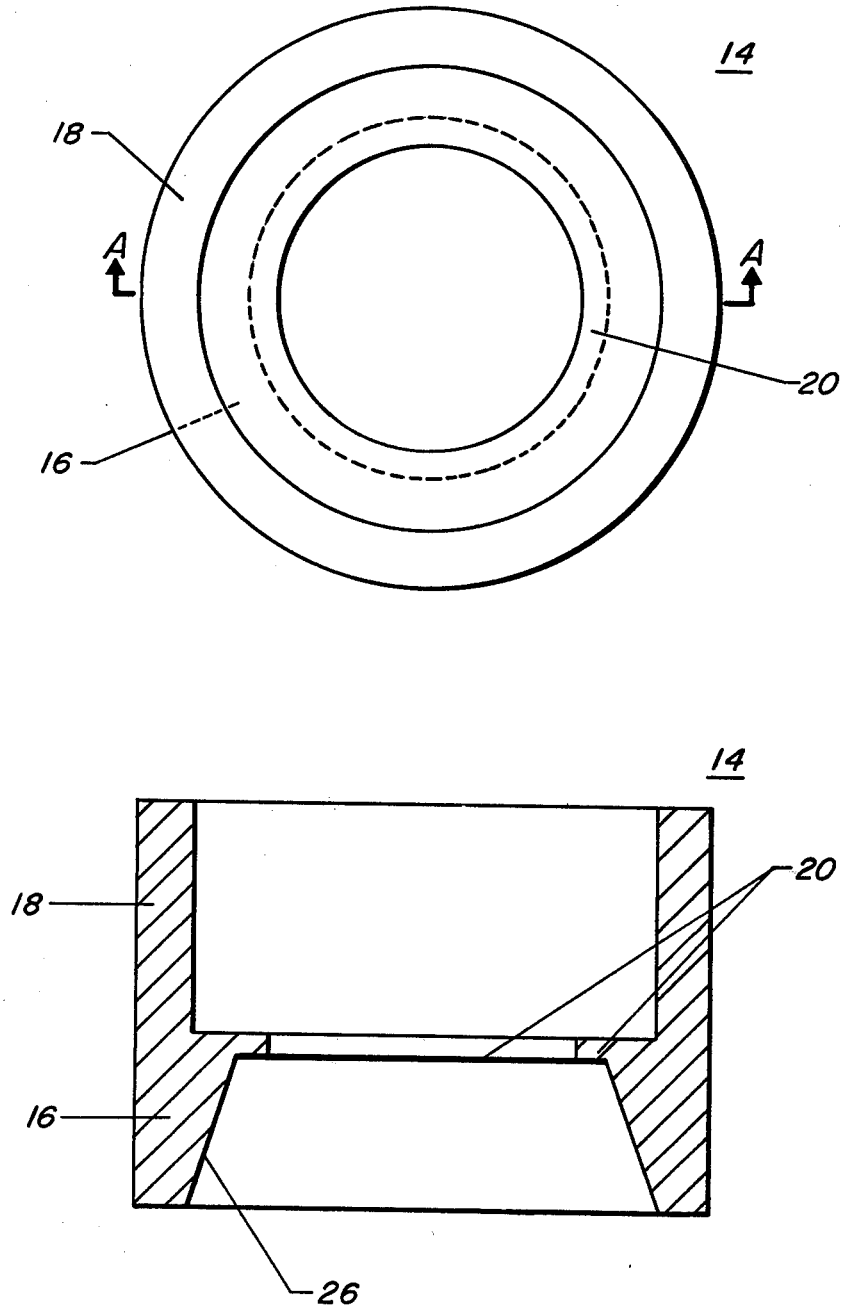
FIG. 1 includes a top view of the inventive collar, and cross-sectional elevation taken along line A—A of the top view.

FIG. 1, the inventive structure, may be seen to include a hollow elongated collar member generally designated by reference numeral 14 having a tapered portion 16 and a cylindrical portion 18 formed thereon. The inner and outer walls of collar 14 are substantially concentric along portion 18 but convergent along portion 16 due to the slope of inner wall 26. At an intermediate location between the opposite ends of collar 14, portions 16 and 18 are divided by a radially inwardly projecting flange-like protuberance 20.

Figure 2:
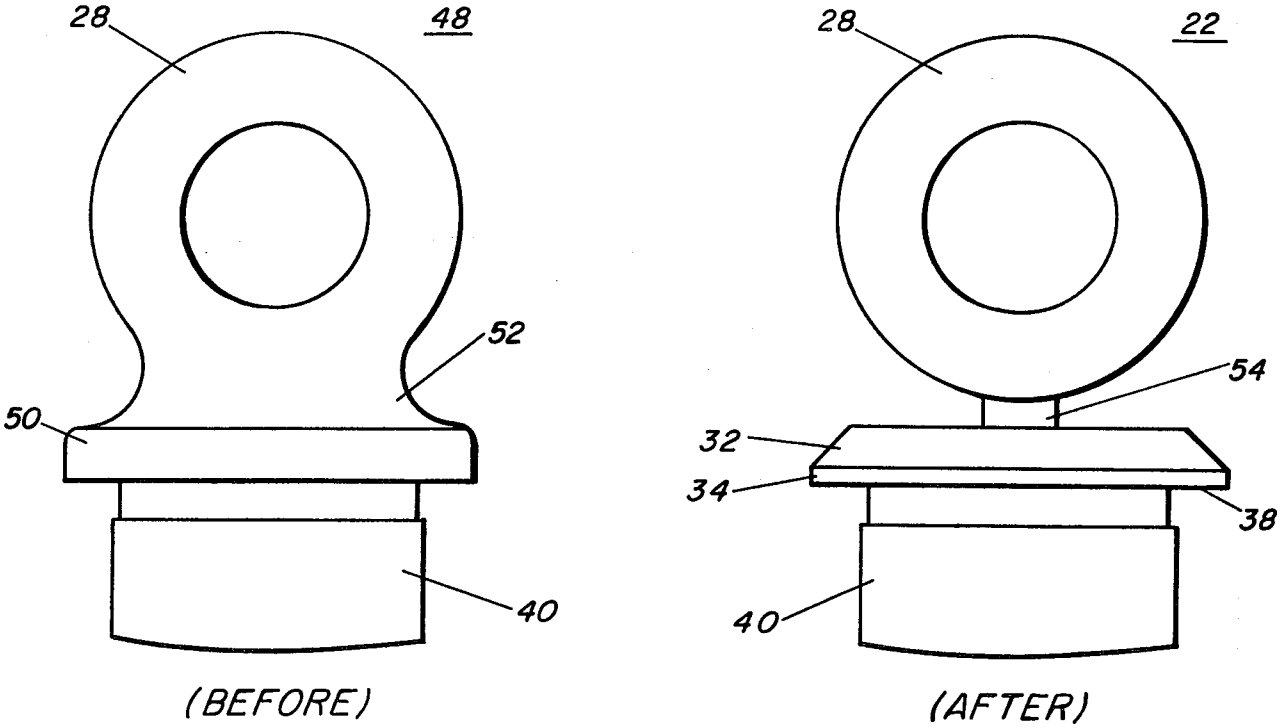
FIG. 2 includes a side view of a prior art lift plug and a similar view of the lift plug proposed by this invention.
Figure 3:
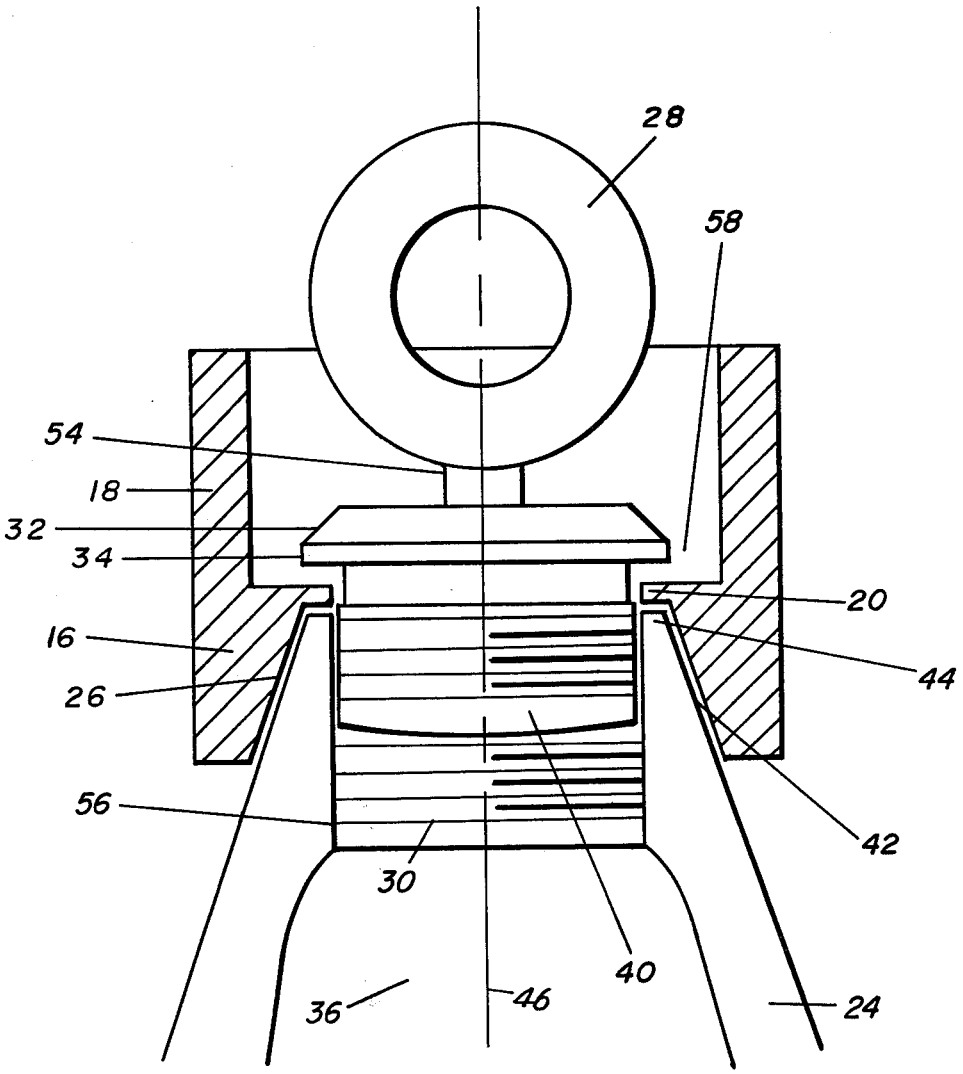
FIG. 3 is a side view partly in cross-section of the collar and lift plug assembled in general relationship with a typical projectile.

Referring to FIG. 2, the inventive structure includes a flanged plug 22 dimensioned and adapted to be secured within the fuze well of a projectile 24, such as by threaded interengagement in the manner suggested by FIG. 3. Plug 22 has a ring-shaped lug or loop 28 integrally formed thereon, and a threaded shank portion 40 of cylindrical shape to engage oppositely corresponding threads within the projectile fuze well 30. Intermediate ring 34 and shank 40 is a radially outwardly projecting flange 34 having a bearing surface 38 thereon adapted to make substantially uniform continuous area contact with faying surface on flange 20 of collar 14 when the inventive components are assembled in operative relationship.

Figure 4:
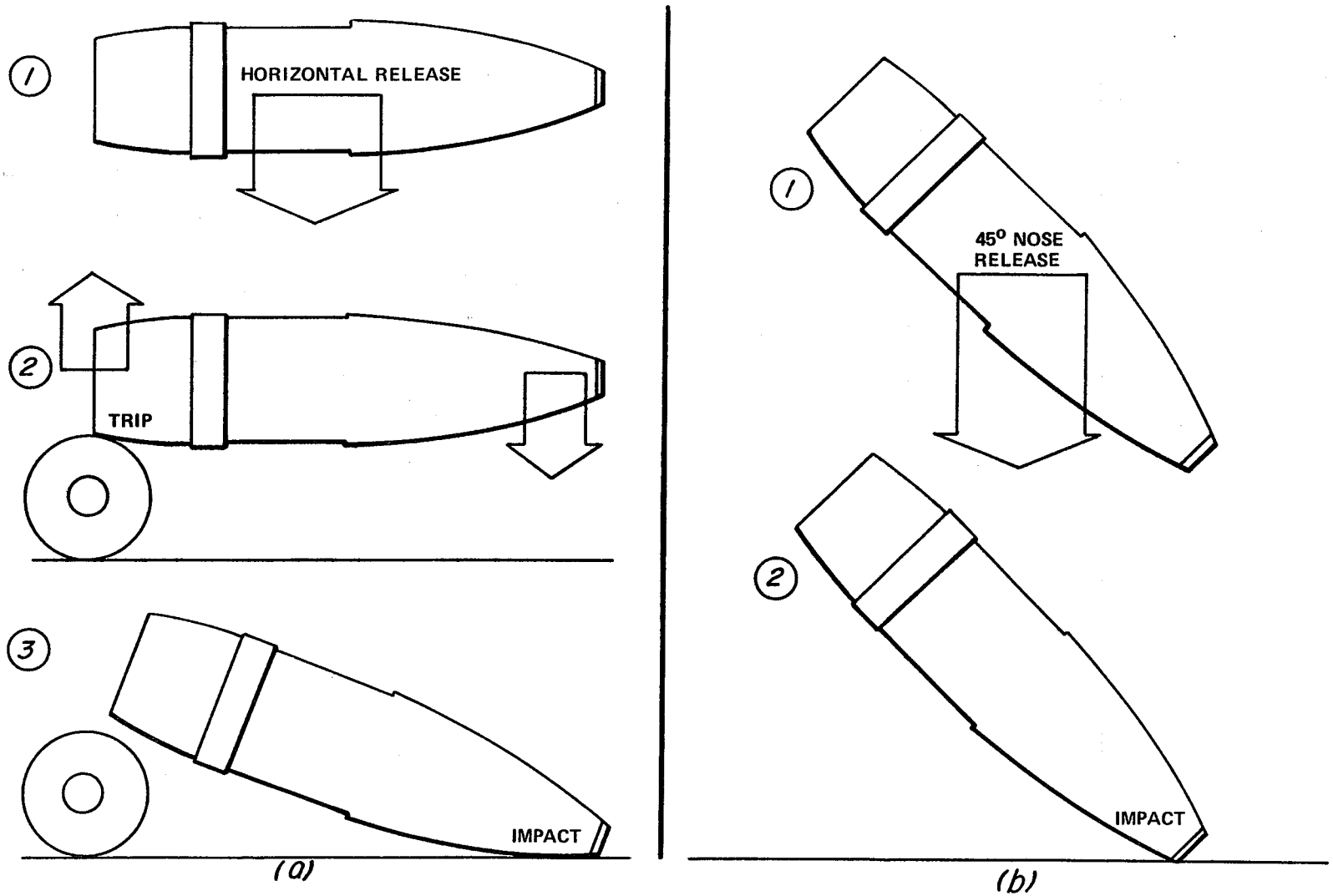
FIG. 4 shows the two most severe drop situations, representative of rough handling for which the inventive structure is intended to prevent projectile damage; the lift plug is not shown in FIG. 4 but was used during the drops.

FIG. 3 suggests the general arrangement of the inventive components in relation to a projectile 24 having a fuze well 30 formed in the nose portion thereof. Fuze well 30 has a threaded generally cylindrical inner wall 56 extending between the projectile internal area 36 and the exterior of the projectile. Fuze well 30 is concentric about the longitudinal center axis 46 of projectile 24. Aerodynamic contouring of the projectile to reduce drag forces results in a familiar ogive shape involving conically sloping outer projectile wall surface 42 which converges toward the axis 46 and terminates in a relatively thin lip 44 at the distal edge of the wall 42 of projectile 24. It is the primary function of the invention in this case to avoid or minimize damage due to impacts which occur at a location proximate lip 44, such as suggested by the types of projectile drops shown in FIG. 4.

OPERATION

Referring to the traditional form of lift plug 48 seen from FIG. 2 and used for lifting projectiles during manufacture, shipments and handling thereof, the plug 48 includes a relatively heavy flange 50 thereon. When threaded shank 40 of plug 48 is fully engaged within a projectile fuze well, it will be understood that flange 50 is in direct and substantially uniform circumferential contact with the distal edge of the fuze well lip 44. As thus installed, dropping of the projectile in the manner seen from FIG. 4 may cause ring portion 28 of plug 48 to strike a hard surface such as concrete. When this happens, the force applied to plug 48 is transmitted to the projectile through the fuze well, principally at its lip area 44 which is least capable of sustaining concentrated stress without cracking. The ability of plug 48 to transmit stress is purposely assured in its design by the heavy web or fillet area 52 joining ring portion 28 to flange 50 of the plug so that little relative displacement or deformation can occur between the two stated portions.

The inventive design of plug 22, as distinguished from plug 48, specifically weakens the connection between ring portion 28 and flange 34 for the purpose of interrupting the stress path sufficiently to permit deformation of material between the ring and the flange. Thus, neck or shank portion 54 extending between ring 28 and flange 34 is sized and dimensioned to sustain static loads, but will deform under most shock loading conditions such as associated with sudden impacts. It will be understood that deformation of material in plug 22 dissipates energy, whereby a substantial portion of the impact force is immediately diverted so that it never reaches the fuze well in which the plug is engaged. In addition, flange 34 is formed with a beveled or sloping surface 32 which serves to provide for greater plastic deformation of the collar (energy expenditure) before contact is made with the plug and the attenuated force can be transmitted to the fuze well. Plug 22 may be used without collar 14, but maximum protection requires use of the collar.

The operative relationship between collar 14 and plug 28 as seen in FIG. 3 is such that flange 20 on the collar 14 makes substantially uniform and continuous area contact with distal surface of lip 44, while the bearing surface 26 of the collar makes similar uniform contact with the outer projectile wall proximate the fuze well. The nose portion of the projectile is thus in close nesting relationship with the collar.

After the collar 14 is thus situated about the fuze well 30, plug 22, with or without a rubber gasket, is installed by rotation to engage the threaded shank 40 thereof with the threaded well 56. Rotation continues until surface 38 of flange 34 on the plug 22 is in firm and uniform contact with flange 20 of the collar 14. As thus interrelated, any stresses resulting from impacting force applied to ring 28 will not be applied directly to lip 44 but to flange 20 on collar 14 which will dissipate and distribute such forces over a wider area, since collar portions adjacent to the flange 20 are in nesting contact with the projectile outer walls. Similarly, impact force on collar 14 will be distributed over a wider area, thus avoiding force localization at the fuze well lip region 44. Also, deformation of the projecting wall portion 18 of collar 14 will absorb energy rather than transmit it to the lip 44. Added clearance 58 to permit displacement of material in wall 18 is provided by the beveled edge 32 of flange 34 in the event that collar 14 is deformed, whereby impact force applied to wall 18 is not transmitted by the deformed wall contacting ring 28 of the plug.

Comparison testing of the two styles of lift plugs in FIG. 2 has been performed to define the functional advantages of the inventive structure discussed above. Both types of plug were used in repeated drops of seven feet onto a concrete surface using a projectile of eight inches diameter loaded with an inert filler comparable in density to the explosive normally contained in the projectile.

Four biaxial strain transducers were externally bonded at the nose of the projectile beginning close to the fuze well lip and axially spaced one half inch apart from each other. The drops were made with the sensors oriented in the plane of fall, 180 degrees from the impacting side.

The most severe drops encountered were the 45 degrees nose-first drop mode and the horizontal trip drop. These drops were found by actual test data to produce circumferential and axial tension stresses on the order of 50,000 psi for the 45 degree nose-first drop and 90,000 psi for the horizontal trip drop, using the standard plug 48 seen in FIG. 2. Using the inventive structure seen, for example, in FIG. 3, these values were found to be 10,000 psi and 25,000 psi, respectively.

it will be understood that surface 38 on flange 34 makes firm and continuous contact with the surface of flange 20 when these parts are assembled in operative relationship as seen in FIG. 3, whereby plug 22 retains and secures collar 14 in place with flange 20 bearing forcibly against lip 44. Moreover, ring-shaped lug 28 is a generally loop shaped bar integrally formed on top of shank 54 of the plug.

The foregoing disclosure and drawings are merely illustrative of the principles of this invention and are not to be interpreted in a limiting sense. We wish it to be understood that we do not desire to be limited to the exact details of construction shown and described, because obvious modifications will occur to a person skilled in the art.

We claim:

1. A protecting plug for avoiding impact damage to an ogive-shaped projectile having a hollow well formed on the forward nose portion thereof, comprising:

plug means adapted to engage and plug said hollow well, said plug means having a plastically deformable radially outwardly projecting flange-like annular protuberance extending therefrom, and said plug means further having lifting lug means integrally formed thereon, and a plastically deformable shank portion extending between said protuberance and said lug means, whereby stress due to impact loads applied to said plug means will be dissipated through plastic deformation of said plug means.

2. The structure of claim 1, further including:

hollow elongate cylindrical collar means having a radially inwardly projecting flange-like annular protuberance adapted to contact said outwardly-projecting protuberance on said plug means.

3. The structure of claim 2, further including a generally conical bearing surface on said collar means adapted to contact the outer surface of said projectile in substantially uniform and continuous area contact.

4. The structure of claim 3, wherein:

said plug means engages said hollow well by interengagement of a threaded shank portion on said plug means and a threaded generally cylindrical inner wall in said hollow well.

5. The structure of claim 4, wherein:

said hollow well is concentric about the longitudinal center axis of said ogive-shaped projectile at said nose portion, and forms a relatively thin lip at the distal edge defined by said hollow well and said outer surface of said projectile, and said inwardly projecting protuberance on said collar means contacts said lip.

6. The structure in claim 5, wherein:

said outwardly projecting protuberance on said plug means makes firm and uniform contact with said inwardly projecting protuberance on said collar means to retain said collar in firm and continuous contact with said lip when said plug means and said collar means are in operative relationship with said projectile.

7. The structure of claim 1 wherein said plug means is threaded permitting engagement with said hollow well.

8. The structure of claim 2 wherein said lifting lug means comprises a generally loop shaped bar integrally formed on top of said shank.

9. The structure of claim 3 wherein said collar means fits over said hollow well and said inwardly projecting protuberance seats on said forward nose portion, and said plug means threadably engages said hollow well until said inwardly projecting protuberance firmly and continuously bears against said projectile.

* * * * *